United States Patent [19]

Cooke

[11] 4,233,087

[45] Nov. 11, 1980

[54] PHOSPHATE COATING PROCESS

[75] Inventor: Brian A. Cooke, Knotty Green, England

[73] Assignee: Imperial Chemical Industries Limited, London, England

[21] Appl. No.: 962,482

[22] Filed: Nov. 20, 1978

[30] Foreign Application Priority Data

Nov. 29, 1977 [GB] United Kingdom ..... 49608/77

[51] Int. Cl.[2] ..... C23F 7/10; C23F 7/12

[52] U.S. Cl. ..... 148/6.15 Z

[58] Field of Search ..... 148/6.15 Z

[56] References Cited

U.S. PATENT DOCUMENTS

| | | | |
|---|---|---|---|
| 3,607,453 | 9/1971 | Engesser et al. | 148/6.15 Z |
| 4,071,379 | 1/1978 | Cooke et al. | 148/6.15 Z |
| 4,089,710 | 5/1978 | Cooke | 148/6.15 Z |

FOREIGN PATENT DOCUMENTS

| | | | |
|---|---|---|---|
| 2617820 | 11/1976 | Fed. Rep. of Germany | 148/6.15 Z |
| 50-139039 | 11/1975 | Japan | 148/6.15 Z |
| 1415999 | 12/1975 | United Kingdom | 148/6.15 Z |
| 1487866 | 10/1977 | United Kingdom | 148/6.15 Z |

*Primary Examiner*—Ralph S. Kendall

*Attorney, Agent, or Firm*—Cushman, Darby & Cushman

[57] ABSTRACT

A continuous process for coating ferrous or zinciferous metal substrates using an acidic coating solution of zinc phosphate in the presence of hydrogen peroxide wherein (a) the molar ratio ortho phosphate/zinc in solution is maintained in the range 0.5–3.7, and (b) the coating solution is replenished with hydrogen peroxide, replenishment feed (i) (comprising zinc, ortho phosphate and anion $N^{n-}$), and replenishment feed (ii) (comprising alkali), the ratio of the quantities of (i) and (ii) being defined. The acid $H_nN$ has a $pK_a$ value not greater than 3.

8 Claims, No Drawings

PHOSPHATE COATING PROCESS

This invention relates to a continuous process of treating ferrous or zinciferous metal substrates with an acidic solution of zinc phosphate to obtain a phosphate coating thereon.

Conventional processes of treating a metal substrate with acidic solutions of zinc or other metal phosphates have heretofore required the use of elevated temperatures, for example in the range 45°–90° C., in order to obtain satisfactory coatings. In both spray and dip processes for treating metal substrates the maintenance of such elevated temperatures requires the continual input of energy, for example by the use of heating coils. It is clearly desirable to conserve energy, for example by lowering the operating temperature of the phosphating process, but heretofore it has not been possible to operate at temperatures significantly lower than about 40° C. without an unacceptable lowering in the quality of the phosphate coatings produced.

We have now found that under specified conditions relating to the composition of the phosphating solution and to the replenishment thereof, very satisfactory phosphate coatings can be achieved over a wide range of temperatures which includes not only the heretofore conventional elevated temperatures but also low temperatures, for example temperatures of less than 45° C. Thus, satisfactory coatings may be obtained at a temperature of 30° C. or even lower. Another advantage of our invention is the continuous production on metal workpieces of coatings having uniform properties, especially in regard to coating weight and coating structure. A further advantage is moderate consumption of replenishing chemicals and the production of moderate amounts of sludge.

According to the invention, we provide a continuous process of applying a phosphate coating to a ferrous or zinciferous metal substrate by treating the said substrate with an acidic phosphating solution of zinc phosphate in the presence of hydrogen peroxide or of a hydrogen peroxide-liberating substance wherein the phosphate solution comprises:

(a) 0.005–0.5 g. atmos of zinc (Zn) per liter of solution
(b) 0.0002–0.02 g. moles of hydrogen peroxide per liter of solution, and
(c) ortho phosphate ($PO_4$) such that the molar ratio $PO_4$/Zn in solution is in the range 0.5–3.7, and wherein, as phosphating proceeds, the solution is replenished with hydrogen peroxide or with a hydrogen peroxide-liberating substance and with at least two other replenishment feeds, replenishment feed (i) and replenishment feed (ii), to maintain the solution at a desired composition as defined in (a), (b) and (c) above and wherein:

replenishment feed (i) comprises sufficient zinc (Zn) to maintain the desired concentration (a) in the solution, and sufficient ortho phosphate ($PO_4$) together with another anion $N^{n-}$ to maintain the molar ratio $PO_4$/Zn in the solution within the range defined in (c), the replenishment feed (i) having a free acidity of F gram equivalents/Kg of the said feed, and replenishment feed (ii) comprises an alkaline material and has a total alkalinity of A gram equivalents/Kg of replenishment feed (ii);

the ratio of the quantities of replenishment feeds (ii) and (i) respectively which are added to the phosphating solution within a significant period of time being (XF/A) where the value of X is in the range 0.5–1.5, and the anion $N^{n-}$ being selected such that the acid $H_nN$ has a $pK_a$ value in the nth dissociation step not greater than 3.

Preferably the anion $N^{n-}$ is selected from $NO_3^-$, $SO_4^{2-}$, and $Cl^-$. The anion $N^{n-}$ may also be derived from certain other strong acids which do not harm the coating process for example anions such as $SiF_6^{2-}$, $Br^-$, $BF_4^-$, $ClO_3^-$, $BrO_3^-$; n may be 1 or 2.

Preferably the value of X is in the range 0.6–1.1.

By a continuous phosphating process we mean a process in which a series of metal substrates are, or a continuous metal substrate is, phosphated in a phosphating solution such that essential ingredients of the solution and progressively consumed and must be replaced to ensure that a satisfactory phosphate coating is obtained on a succession of substrates or on all parts of a continuous substrate treated in the solution.

With regard to the requirement that the quantity of replenishment feeds (ii) and (i) respectively should be added to the phosphating solution in a defined ratio within a significant period of time we prefer that the addition of the two feeds (ii) and (i) is coordinated with respect to time; and more preferably the two feeds are added simultaneously. Alternatively the requirement may be met by making the additions of (ii) and (i) over some period of time depending, for example, on the throughput of metal to be phosphated. Thus, for example, additions of the two feeds may be separated by time intervals of up to several hours, but this is not generally desired.

The free acidity of replenishment feed (i) is determined by titrating a suitably diluted sample of the feed against a standard solution of caustic alkali, the titration being terminated at a pH in the range 3.8–4.5. Suitable indicators which exhibit a colour change in this range include methyl orange and bromophenol blue. The free acidity (F) expressed as gram equivalents/Kg of the replenishment feed (i) may be determined from the resulting titre.

The total alkalinity of replenishment feed (ii) is determined by titrating a suitably diluted sample of the feed against a standard solution of mineral acid, the titration being terminated at pH 3.0. (If feed (ii) contains only a strong alkali, e.g. sodium hydroxide, the terminal pH of the titration is relatively immaterial in the range 3 to 10). Suitable indicators which can be used include methyl orange and bromophenol blue.

Suitable alkaline materials for the purpose of this invention for use in replenishment feed (ii) include the hydroxides, carbonates or bicarbonates of alkali or alkaline earth metals the essential criterion being that the alkaline material be soluble in water at the concentration selected for replenishment feed (ii), which may range between 0.01 and 10 g. equivalents of alkali per liter of solution. Alkali metal hydroxides, carbonates and bicarbonates all fulfil this requirement at reasonable levels of concentration.

An important feature of this invention is our finding that, in a continuous process of phosphating metal substrates using a hydrogen peroxide-accelerated acidic zinc phosphate solution, a satisfactory and consistent phosphate coating can be achieved over a wide range of temperatures only when the molar ratio $PO_4$/Zn in the phosphating solution is maintained in the range 0.5 to 3.7. Preferably the molar ratio $PO_4$/Zn is in the range 1.5–3.0. In conventional practice, in a continuous spray-phosphating process using a hydrogen peroxide-accelerated acidic solution of zinc phosphate, the working solution is replenished with hydrogen peroxide and with an acidic concentrate which comprises in solution zinc and phosphate, so as to maintain the zinc content substantially constant. Since, in order to ensure stability in storage (especially at low temperatures), such replenishment concentrates are relatively more acidic than the phosphating bath, it is necessary also to add to the phosphating bath and quantity of alkali, usually an alkali metal hydroxide, which neutralises (at least partially) the excess acidity introduced by the replenishment concentrate. However, as the alkali metal ion accumulates in the working solution, there is a corresponding accumulation in the working solution of alkali metal phosphate, e.g. of $NaH_2PO_4$. Thus, there is a steady increase in concentration of phosphate in the working solution for a given concentration of zinc, and whereas the initial ratio of $PO_4/Zn$ may have been selected to lie within the desired range 0.5 to 3.7, after continued working the ratio $PO_4/Zn$ may well exceed 3.7 when the working solution approaches or has reached a steady state, and then satisfactory phosphate coatings will not be produced over a wide range of working temperatures, more particularly at low temperature. At higher temperatures of operation and quality of coating produced suffers at the molar ratio $PO_4/Zn$ passes above the value of 3.7.

The present invention provides a means whereby, at a given concentration of zinc the desired and initial ratio $PO_4/Zn$ can be maintained as phosphating proceeds and as replenishment material are added, thus ensuring satisfactory and consistent phosphate coatings over a wide range of temperatures. This is made possible by the presence in the replenishment feed (i) of a suitable proportion of an anion $N^{n-}$. It is well known that solutions employed in metal pretreatment operations attain a steady state of composition which is a function of the relative reactivity of the various constituents and of certain physical characteristics of the equipment in which they are employed, notably of the rate of liquid input or loss experienced as articles pass through the spray zone or dipping bath. The theoretical basis of this occurrence is discussed, for example, in Transactions of the Institute of Metal finishing 1975, Vol. 53, 153–1576. Whilst the theoretical approach is possible in principle, the required accurate values of the relevant parameters are not usually available and those skilled in the art will recognise that the question can be approached empirically. In the present case, the requirements of this invention will normally be satisfied if replenishment feed (i) contains ions $N^{n-}$ in relation to ortho-phosphate in a minimum molar ratio of (0.05/n). A preferred range for this ratio is (0.2/n) to (0.4/n). The maximum value of this ratio is governed by the necessity to have a sufficient ortho-phosphate content in the bath for it to function continuously: thus it would not normally exceed (1.0/n).

It is preferred to incorporate the anion $N^{n-}$ into the replenishment feed (i) as the free acid $N_nN$, for example together with zinc oxide and phosphoric acid. The $pK_a$ of an acid HA is derived from $pK_a = -\log_{10} K_a$ where $K_a = [H+][A+]/[HA]$.

The function of the anion $N^{n-}$ in the phosphating bath is that of an anionic diluent. It is present solely to facilitate the maintenance of the molar $PO_4/Zn$ ratio in the bath within the range 0.5 to 3.7. Whilst the anions $SO_4^{2-}$ and $Cl^-$ are clearly incapable of functioning as oxidising accelerators in a phosphating process and are thus only anionic diluents within the scope of this invention, anions such as $NO_3^-$, $ClO_3^-$ and $BrO_3^-$ can function as oxidising accelerators under certain conditions. However, since the hydrogen peroxide which is also present is strongly oxidising and rapid-acting the oxidising role played by these anions is insignificant. With regard to the preferred anion $NO_3^-$ those skilled in the art will recognise that in any case it may function as an oxidising accelerator only at high concentrations and at operating temperatures above 60° C., a combination of conditions which is not suitable for the operation of the present process, for example by spraying.

The hydrogen peroxide or hydrogen peroxide-liberating substance is usually added to the phosphating solution as a separate replenishment feed but, according to the invention, it may be added together with replenishment feed (ii). Some hydrogen peroxide-liberating substances, e.g. the alkali perborates, persulphates, peroxydiphosphates, percarbonates and peracetates, also liberate a substance which may disturb the acidity of the phosphating solution. Thus, perborates, peroxydiphosphates, percarbonates and peracetates liberate alkaline substances while persulphate liberates an acidic substance into the solution. In carrying out the invention, it may be necessary to take such incidental alkali or acid additions into account insofar as they may cause a deviation from the stated relation between alkali and acid feed rates in the range already defined as (XF/A). Peroxy adducts of certain substances, e.g. peracetic acid, by releasing an undissociated species into the solution (acetic acid being too weak to dissociate at a pH value of about 3 which is the usual pH of the phosphating solution) do not give rise to a disturbance of the bath acidity.

The concentration of hydrogen peroxide in the phosphating solution used in the process of this invention may be controlled by the method described in our copending U.S. pat. application Ser. No. 810,354 filed June 24, 1977.

Preferably there is maintained in the phosphating solution and concentration of hydrogen peroxide of 0.001–0.004 g.moles/liter of solution.

Preferably the concentration os zinc in the phosphating solution is in the range 0.01–0.1 g. atoms zinc/liter of solution.

The metal substrate may be treated according to the invention for example by spraying the substrate with the phosphating solution or by immersing the substrate in a bath of the phosphating solution. Preferably treatment is by spraying and optionally in combination with an immersion treatment.

The phosphating solution may contain any conventional additive necessary to the production of a satisfactory result under the various possible working conditions; for example, there may be present fluoride, glycerophosphate, polyphosphates of nickel. Also the metal to be treated may comprise in addition to a ferrous and/or zinciferous metal, other metals such as aluminium.

The invention is illustrated with reference to the following Examples in which parts are by weight.

EXAMPLE 1

This Example illustrates the use of a phosphating bath in coating steel panels wherein (a) the molar ratio of phosphate to zinc in the bath is initially within the limits which are specified in the present invention and a satisfactory phosphate coating is produced on a metal panel;

but wherein, (b) as the phosphating of further panels proceeds and the bath is replenished conventionally to maintain a constant level of zinc, this ratio moves outside the specified limits and a negligible phosphate coating is ultimately produced. Example 1(c) illustrates a continuous coating process according to the invention wherein there is present $NO_3^-$ as the anion $N^{n-}$.

(a) An acidic phosphating solution of zinc phosphate containing hydrogen peroxide as accelerator was prepared which comprised:
- 0.143 g.mol orthophosphate (as $PO_4$) per liter of solution
- 0.051 g.atoms zinc (as Zn) per liter of solution
- 0.037 g.atoms sodium (As Na) per liter of solution, and
- 0.002 g.moles hydrogen peroxide (as $H_2O_2$) per liter of solution The molar ratio $PO_4/Zn$ in the solution was 2.8 which is within the limits defined in the present invention. The ratio of free acid to the total acid of this phosphating solution at 30° C. was less than 0.05.

The above solution was sprayed onto a degreased rolled steel panel for 90 seconds at 30° C. to produce a coating of zinc phosphate which when painted showed excellent resistance to corrosion. The coating weight was 1.6 g/m$^2$.

(b) As a succession of degreased steel panels was coated by spraying as described in (a) the phosphating solution was replenished to maintain the zinc content constant by adding appropriate quantities of (i) an acidic concentrate of zinc phosphate (containing 9.4% Zn and 38.5% $PO_4$) and (ii) a solution of sodium hydroxide (which was necessary to control the ratio of free to total acidity in the bath at 30° C. below a value of 0.05). Further hydrogen peroxide was also added in order to maintain the concentration defined in Example 1(a).

The quality of the phosphate coating diminished with the number of panels processed and it was noted that the phosphating solution reached a steady state only when it had the composition:
- 0.219 g.mol. phosphate (as $PO_4$) per liter of solution
- 0.051 g.atoms zinc (as Zn) per liter of solution
- 0.113 g.atoms sodium (As Na) per liter of solution This solution gave a coating weight of only 0.06 g/m$^2$ on the degreased steel panels when sprayed for 90 seconds at 30° C. The molar ratio $PO_4/Zn$ was then 4.3 which is outside the limits of the present invention.

(c) An acidic phosphating solution of zinc phosphate containing hydrogen peroxide as accelerator and additionally nitrate ions (where $NO_3^- = N^{n-}$ according to the invention; $pK_a$ of $HNO_3$ is less than 1) was prepared which comprised:
- 0.143 g.mol. phosphate (as $PO_4$) per liter of solution
- 0.051 g.atoms zinc (as Zn) per liter of solution
- 0.113 g.atoms sodium as (Na) per liter of solution
- 0.076 g.mol. nitrate (as $NO_3$)per liter of solution and
- 0.002 moles hydrogen peroxide (as $H_2O_2$) per liter of solution.

The molar ratio $PO_4/Zn$ was 2.8 as in Example 1(a).

When sprayed onto degreased rolled steel panels for 90 seconds at 30° C. a coating of zinc phosphate was produced which when painted showed excellent resistance to corrosion. The coating weight was 1.6 g/m$^2$.

The composition of the above coating solution could be maintained substantially as given above (and hence the molar ratio $PO_4/Zn$ and the Zn content were both maintained substantially constant) by addition to the coating solution of further hydrogen peroxide and two replenishment feeds (i) and (ii)

(i) comprising:

| | | |
|---|---|---|
| 59% | nitric acid | 11.5 parts |
| | zinc oxide | 12.2 parts |
| 81% | phosphoric acid | 32.8 parts |
| | water | 43.5 parts |

which had a free acidity (F) of 0.79 g. equivalents/Kg fo feed (i) and (ii) comprising:

| | |
|---|---|
| sodium hydroxide | 5.5 parts |
| water | 94.5 parts |

which had a free alkalinity (A) of 1.38 g.equivalents/Kg of feed (ii) in a delivery ratio (by weight) (ii)/(i) of 0.57 Kg (ii/1 Kg (i).

Thus according to the requirement of the invention $$X=1$$

since $$F/A=0.79/1.38=0.57$$

Throughout the operation, in which a succession of panels was sprayed with the bath solution at 30° C. and with a contact time of 90 seconds per panel, highly satisfactory coatings were produced of uniform coating weight close to 1.6 g/m$^2$.

EXAMPLE 2

In another continuous phosphating process according to the invention the anion $N^{n-}$ was $SO_4^{2-}$.

Degreased rolled steel panels were sprayed at 30° C. for 90 seconds with an acidic phosphating solution of zinc phosphate which comprised:
- 0.143 g.mol phosphate (as $PO_4$)/liter of solution
- 0.051 g.atoms zinc (as Zn)/liter of solution
- 0.113 g.atoms sodium (as Na)/liter of solution
- 0.038 g. mol sulphate (as $So_4$)/liter of solution and
- 0.002 g. moles hydrogen peroxide (as $H_2O_2$)/liter of solution The coating weight of the panels was 1.5g/m$^2$. As a succession of panels were treated the coating solution was replenished to maintain substantially the above concentrations in the same manner as that described in Example 1(c) except that the nitric acid in replenishment (i) was replaced by an equivalent amount of sulphuric acid. A uniform coating weight of 1.5 g/m$^2$ was obtained on the succession of panels which was treated as described.

EXAMPLE 3

This example illustrates continuous processes according to the invention operated at both 50° C. and 30° C. Very low coating weights were achieved (a) Degreased rolled steel panels were sprayed at 50° C. for 2 minutes with an acidic phosphating solution of zinc phosphate which comprised:
- 0.100 g.mol phosphate (as $PO_4$)/liter of solution
- 0.036 g.atoms zinc (as Zn)/liter of solution
- 0.079 g.atoms sodium (as Na)/liter of solution
- 0.053 g.moles nitrate (as $NO_3$)/liter of solution 0.002 g.moles hydrogen peroxide (as $H_2O_2$)/liter of solution.

The coating weight of the panels was 1g/m$^2$. The composition of the phosphating solution was maintained by addition of further hydrogen peroxide and the same concentrates used in Example 1(c) so as to maintain the total acid content at 12.5–13.0 points (mls N/10 to neutralise a 10 ml sample of the solution against phenolphihalein indicator).

When a phosphated panel was painted by cathodic electrodeposition with a high epoxy-content primer, the paint coating had exceptionally good adhesion properties.

(b) when the process of (a) was repeated at 30° C., a coating weight of 1.6g/m$^2$ was obtained and the phosphated panel had similar properties to that in (a).

We claim:

1. A continuous process of applying a phosphate coating to a ferrous or zinciferous metal substrate by treating the said substrate with an acidic phosphating solution of zinc phosphate in the presence of hydrogen peroxide or of a hydrogen peroxide-liberating substance wherein the phosphating solution comprises:

(a) 0.005–0.5 g.atoms of zinc (Zn) per liter of solution.

(b) 0.0002–0.02 g.moles of hydrogen peroxide per liter of solution and (c) orthophosphate ($PO_4$) such that the molar ratio $PO_4$/Zn in solution is in the range 0.5–3.7, and wherein, as phosphating proceeds, the solution is replenished with hydrogen peroxide or with a hydrogen peroxide-liberating substance and with at least two other replenishment feeds, replenishment feed (i) and replenishment feed (ii), to maintain the solution at a desired composition and defined in (a), (b) and (c) above and wherein:

replenishment feed (i) comprises sufficient zinc (Zn) to maintain the desired concentration (a) in the solution, and sufficient orthophosphate ($PO_4$) together with another anion $N^{n-}$ to maintain the molar ratio $PO_4$/Zn in the solution within the range defined in (c), the replenishment feed (i) having a free acidity of F gram equivalents/Kg of the said feed, and replenishment feed (ii) comprises an alkaline material selected from the group consisting of the hydroxides, carbonates and bicarbonates of alkali and alkaline earth metals, said alkaline material being soluble in water at the concentration of said replenishment feed (ii) and has a total alkalinity of A gram equivalents/Kg of replenishment feed (ii);

the ratio of the quantities of replenishment feeds (ii) and (i) respectively with are added to the phosphating solution within a significant period of time being (XF/A) where the value of X is in the range 0.5–1.5, and the anion $N^{n-}$ being selected such that the acid $H_nN$ has a $pK_a$ value in the nth dissociation step not greater than 3.

2. A process according to claim 1 wherein the anion $N^{n-}$ is selected from $NO_3^-$, $SO_4^{2-}$ and $Cl^-$.

3. A process according to claim 1 wherein the molar ratio $PO_4$/Zn is in the range 1.5 to 3.0.

4. A process according to claim 1 wherein the value of X is in the range 0.6–1.1.

5. A process according to claim 1 wherein the replenishment feed (i) contains anion $N^{n-}$ in relation to orthophosphate in a minimum molar ratio of 0.05/n.

6. A process according to claim 5 wherein the molar ratio is in the range 0.2/n to 0.4/n.

7. A process according to claim 1 wherein the concentration of hydrogen peroxide is in the range of 0.001–0.004 g.moles/liter of solution.

8. A process according to claim 1 wherein the concentration of zinc is in the range 0.01–0.1 g.atoms/liter of solution.

* * * * *